US011332923B2

(12) United States Patent
Peachy et al.

(10) Patent No.: US 11,332,923 B2
(45) Date of Patent: May 17, 2022

(54) ROTATIONAL CONNECTIONS FOR STAIRS

(71) Applicant: EMEH, INC., Lebanon, NJ (US)

(72) Inventors: Anthony J. Peachy, Muncy, PA (US); Robert J. Belvin, Williamsport, PA (US); Kevin W. Smith, Hughesville, PA (US); Darko Ostojic, Hughesville, PA (US)

(73) Assignee: EMEH, INC., Lebanon, NJ (US)

( * ) Notice: Subject to any disclaimer, the term of this patent is extended or adjusted under 35 U.S.C. 154(b) by 0 days.

(21) Appl. No.: 17/255,983

(22) PCT Filed: Jun. 13, 2019

(86) PCT No.: PCT/US2019/037023

§ 371 (c)(1),
(2) Date: Dec. 23, 2020

(87) PCT Pub. No.: WO2020/005560

PCT Pub. Date: Jan. 2, 2020

(65) Prior Publication Data

US 2021/0115658 A1 Apr. 22, 2021

Related U.S. Application Data

(60) Provisional application No. 62/691,058, filed on Jun. 28, 2018.

(51) Int. Cl.
*E04B 1/36* (2006.01)
*E04B 1/98* (2006.01)
(Continued)

(52) U.S. Cl.
CPC ..... *E04B 1/36* (2013.01); *E04B 1/98* (2013.01); *E04F 11/022* (2013.01); *E04H 9/021* (2013.01)

(58) Field of Classification Search
CPC ..... E04F 11/062; E04F 2011/0203; E04F 11/022; E04B 1/98; E04B 1/36; E04H 9/021
See application file for complete search history.

(56) References Cited

U.S. PATENT DOCUMENTS 2,220,155 A * 11/1940 Jachim ..... E04F 11/062 182/1
3,299,590 A * 1/1967 Carter ..... E04F 11/0255 52/183
(Continued)

FOREIGN PATENT DOCUMENTS

WO WO 2018/212956 A1 11/2018

OTHER PUBLICATIONS

International Search Report dated Oct. 25, 2019 in International Application No. PCT/US19/37023.

*Primary Examiner* — Rodney Mintz
(74) *Attorney, Agent, or Firm* — Baker Botts L.L.P.

(57) ABSTRACT

The present disclosure relates to stair systems and methods for allowing stair movement, including rotational movement, between building levels while maintaining the structural integrity of the stair system for safe egress passage and ingress passage. The systems and methods of the present disclosure allow for independent movement of the surrounding building walls, landings, floor slabs, and/or any other portion of the surrounding building structure or stair system. Embodiments of the present disclosure are suitable for use in both new constructions as well as in existing constructions for retrofit applications to allow for movement between levels, landings, or within stairwell structures. The present disclosure can reduce stair damage during building movement whether it is from wind, thermal, explosive, or seismic activity, and/or any other type of suitable force or experi-
(Continued)

ence, as the present disclosure allows for rotational movement, longitudinal movement, or a combination thereof.

23 Claims, 9 Drawing Sheets

(51) Int. Cl.
*E04F 11/022* (2006.01)
*E04H 9/02* (2006.01)

(56) References Cited

U.S. PATENT DOCUMENTS 3,626,438 A * 12/1971 Cornell ..... E04F 11/0255 52/183
3,691,712 A * 9/1972 Bowling ..... E04B 1/98 52/393
3,693,754 A * 9/1972 Butler ..... E04F 11/062 182/86
3,912,298 A * 10/1975 Humphrey ..... B60R 3/02 280/166
3,946,833 A * 3/1976 Riehlmann ..... E06C 9/08 182/20
3,997,026 A * 12/1976 Riehlmann ..... E06C 1/125 182/96
4,039,050 A * 8/1977 Bowling ..... E04B 1/98 188/268
4,347,638 A * 9/1982 Weaver ..... B60R 3/02 14/71.1
4,642,953 A * 2/1987 DeGood ..... E04F 11/06 52/183
4,768,617 A * 9/1988 Mason ..... B64F 1/315 182/1
4,959,935 A * 10/1990 Stob ..... E01D 15/24 182/156
4,971,168 A * 11/1990 Stanescu ..... B63B 27/14 182/1
5,189,854 A * 3/1993 Nebel ..... B63B 27/14 182/1
6,003,270 A * 12/1999 MacIntyre ..... E04H 3/126 52/10
6,324,795 B1 * 12/2001 Stiles ..... E02D 27/34 52/167.4
6,527,081 B1 * 3/2003 Tyner ..... E04F 11/1834 182/1
6,923,140 B1 * 8/2005 Cook ..... E01D 15/24 114/362
7,866,443 B2 * 1/2011 Truckner ..... E04F 11/0255 182/228.1
7,967,110 B2 * 6/2011 Parker ..... E04F 11/068 182/77
8,640,826 B1 2/2014 Beilstein
9,683,372 B2 * 6/2017 Meier ..... E04F 11/0223
9,758,981 B2 9/2017 Charles et al.
9,869,084 B2 1/2018 Charles et al.
10,584,480 B2 * 3/2020 Charles ..... E04B 1/36
10,640,983 B2 * 5/2020 Honeycutt ..... E04F 11/025
10,745,919 B1 * 8/2020 Houston ..... E04B 5/10
10,968,636 B2 * 4/2021 Charles ..... E04F 11/062
2002/0088669 A1 * 7/2002 Truckner ..... E04F 11/1817 182/228.1
2005/0160688 A1 * 7/2005 Truckner ..... E04G 13/06 52/182
2008/0023269 A1 * 1/2008 Parker ..... E06C 9/08 182/195
2008/0190049 A1 * 8/2008 Muti ..... E04G 27/00 52/183
2008/0236065 A1 10/2008 Conservano
2009/0300994 A1 12/2009 Atkins, III et al.
2010/0293875 A1 11/2010 Preston
2011/0162303 A1 * 7/2011 Truckner ..... E04G 13/062 52/183
2011/0271613 A1 11/2011 Hopper
2015/0252568 A1 * 9/2015 Pivetta ..... E04F 19/00 52/188
2016/0102461 A1 4/2016 Charles et al.
2016/0215496 A1 * 7/2016 Charles ..... E04F 11/022
2017/0275888 A1 * 9/2017 Honeycutt ..... E04G 27/00
2018/0100301 A1 4/2018 Charles et al.
2020/0149284 A1 * 5/2020 Charles ..... E04F 11/022
2020/0199881 A1 * 6/2020 Bianchi ..... E04F 11/062
2021/0189734 A1 * 6/2021 Charles ..... E04B 1/36

* cited by examiner

ROTATIONAL CONNECTIONS FOR STAIRS

CROSS-REFERENCE TO RELATED APPLICATIONS

This application is a U.S. National Stage patent application under 35 U.S.C. § 371 of International Patent Application No. PCT/US2019/037023, filed on Jun. 13, 2019, which claims the benefit of priority of U.S. Provisional Patent Application No. 62/691,058 filed on Jun. 28, 2018, the contents of each of which are hereby incorporated by reference in their entireties.

BACKGROUND

Field

Embodiments of the present disclosure generally relate to the field of stair systems and methods. More specifically, embodiments provided herein relate to moveable stairs, including connectors, joints, devices, and configurations for allowing rotational, longitudinal, directional, and/or differential movements between levels or landings, and within stair structures to provide safe egress, enhance rescue, and/or reduce damage during movement.

Description of the Related Art

In multi-level buildings and structures stairs are essential to not only providing a means for moving about the levels but also for providing safe egress out of the structure in the event of an emergency. As such, stair safety is a constant concern as taller buildings continue to be constructed of new and more efficient materials and in various locations around the globe. The construction and installation of stairs create a necessary exit path that is regulated by various building codes which oftentimes require the stairs to survive fire and structural damage such that occupants can safely exit the building during a state of emergency.

Conventional stair assemblies, however, are rigidly connected to a landing or building structure rather than dynamically connected to a landing or building structure. As such, typical stair assemblies do not allow for sufficient movement in the event of building motion (e.g., during a seismic event, high winds, explosions, etc.). Rigidly connected stairs create a force that must be accounted for in the building design. Furthermore, due to the interstory drift that occurs during building motion, rigidly connected stair systems can cause damage to any of the surrounding structure, the area below the stair system, and/or the stair system itself. Rigidly connected stairs can disconnect, crumble, fail, and/or fall during building motion, which prohibits occupants from safely exiting, delays rescue operations, and threatens safety. Moreover, due to interstory drift and the forces generated through a building during building motion, rigidly connected stairs may cause damage to themselves and the surrounding structure, thus causing the structure to perform differently than originally engineered. The results can further include structural damage surrounding the stairs, or partial or total collapse of the stairs. Any damage to and/or collapse of the stair system immediately eliminates a means of egress from the building and places the occupants therein in additional danger during or after a building motion event and/or emergency. Injury or loss of life is also possible depending on the extent of the damage.

Moreover, attempts to solve these problems have been made, but many do not complete full-scale testing, or meet applicable building codes, regulations, and/or project requirements. Prior systems also are not designed or intended to accommodate rotation of the stairs during building movement.

Thus, stair safety and installation can increase building safety and reduce the effects of building motion. Therefore, what is needed in the art is a moveable stair system and method. More specifically, what is needed is a rotational connection for stairs which allows for rotational movement, longitudinal movement, multidirectional movement, and/or orbital capacity to absorb landing displacement thus reducing damage to the stairs.

SUMMARY

The present disclosure relates to stair systems and methods for allowing stair movement, including rotational movement, between building levels while maintaining the structural integrity of the stair system for safe egress passage. The systems and methods of the present disclosure allow for independent movement of the surrounding building walls, landings, floor slabs, and/or any other portion of the surrounding building structure or stair system. The embodiments of the present disclosure are suitable for use in both new constructions as well as in existing constructions for retrofit applications to allow for movement between levels, landings, or within stairwell structures. Moreover, the embodiments of the present disclosure apply to both single and double stringer stairs. The present disclosure can reduce stair damage during building movement whether it is from wind, thermal, explosive, or seismic activity, and/or any other type of suitable force or experience, as the present disclosure allows for rotational movement, longitudinal movement, directional movement, or a combination thereof.

The purpose and advantages of the disclosed subject matter will be set forth in and apparent from the description that follows, as well as will be learned by practice of the disclosed subject matter. Additional advantages of the disclosed subject matter will be realized and attained by the systems and method particularly pointed out in the written description and claims hereof, as well as from the appended drawings.

To achieve the above and other advantages and in accordance with the purpose of the disclosed subject matter, as embodied and broadly described, the disclosed subject matter includes stair systems and methods. In some example embodiments, a stair system is disclosed, which includes a first landing connection system and a second landing connection system. The first landing connection system includes a single-point connection device configured for rotational movement in a combination of an X-direction and a Y-direction. The second landing connection system includes at least one secondary movement connection device configured for longitudinal movement in at least one of the X-direction and the Y-direction.

In some embodiments, the single-point connection device is centrally located within the first landing connection system. In other embodiments, the single-point connection device includes at least one of a shaft configuration, a pin-type configuration, a nut-and-bolt configuration, a ball-and-socket configuration, a hitch-type configuration, a ball-joint-rod-end configuration, a swivel joint configuration, or a configuration in which one or more structural shapes fit together. In certain embodiments, the single-point connection device can include a coupler and a cross channel. Furthermore, in some embodiments, the at least one secondary movement connection device includes a slotted connector, a track system connector, a guide rail connector, a wheeled connector, a roller connector, a slide connector, or a plate connector.

In some example embodiments, a stair system is disclosed, which includes a first landing connection system including a single-point connection device configured for rotational movement in a combination of an X-direction and a Y-direction, and a secondary movement connection device operatively connected with the single-point connection device and configured for longitudinal movement in at least one of the X-direction and the Y-direction.

In some embodiments, the single-point connection device includes at least one of a shaft configuration, a pin-type configuration, a nut-and-bolt configuration, a ball-and-socket configuration, a hitch-type configuration, a ball-joint-rod-end configuration, a swivel joint configuration, or a configuration in which one or more structural shapes fit together. In certain embodiments, the secondary movement connection device comprises a first face having a slot therein, and, in some embodiments, the single-point connection device is at least partially disposed through the slot to operatively connect the secondary movement connection device with the single-point connection device. In some embodiments, the single-point connection device is centrally located within the first face.

In some example embodiments, a moveable stair system is disclosed, which includes a staircase having one or more stairs, a first landing connection system disposed at a first end of the staircase, and a second landing connection system disposed at a second end of the staircase. The first end is opposite the second end. The first landing connection system includes a single-point connection device configured for movement of the staircase in a rotational direction. The movement in the rotational direction is movement in the X-direction and in the Y-direction. The second landing connection system includes a secondary movement connection device configured for movement of the staircase in a longitudinal direction. The movement in the longitudinal direction includes movement in at least one of the X-direction and the Y-direction.

In certain embodiments, the single-point connection device is centrally located within the first landing connection system. In some embodiments, the single-point connection device includes at least one of a shaft configuration, a pin-type configuration, a nut-and-bolt configuration, a ball-and-socket configuration, a hitch-type configuration, a ball-joint-rod-end configuration, a swivel joint configuration, or a configuration in which one or more structural shapes fit together. In certain embodiments, the single-point connection device further includes a coupler and a cross channel. In some embodiments, the secondary movement connection device includes a slotted connector, a track system connector, a guide rail connector, a wheeled connector, a roller connector, a slide connector, or a plate connector. In certain embodiments, the first landing connection system is further operatively connected to a first landing, and the second landing connection system is further operatively connected to a second landing. In certain embodiments, the moveable stair system further includes a landing plate operatively connected to the first landing connection system and configured to cover a gap disposed between the staircase and a first landing.

In some example embodiments, a moveable stair system is disclosed, which includes a staircase having one or more stairs and a first landing connection system. The first landing connection system is disposed at a first end of the staircase. The first end is opposite a second end of the staircase. The first landing connection system includes a single-point connection device and a secondary movement connection device. The single-point connection device is configured for rotational movement in a combination of an X-direction and a Y-direction. The secondary movement connection device is operatively connected with the single-point connection device and configured for longitudinal movement in at least one of the X-direction and the Y-direction.

In some embodiments, the single-point connection device includes at least one of a shaft configuration, a pin-type configuration, a nut-and-bolt configuration, a ball-and-socket configuration, a hitch-type configuration, a ball-joint-rod-end configuration, a swivel joint configuration, or a configuration in which one or more structural shapes fit together. In certain embodiments, the secondary movement connection device includes a first face having a slot therein. The single-point connection device can at least be partially disposed through the slot to operatively connect the secondary movement connection device with the single-point connection device. In some embodiments, the single-point connection device is centrally located within the first face. In certain embodiments, the secondary movement connection device includes a slotted connector, a track system connector, a guide rail connector, a wheeled connector, a roller connector, a slide connector, or a plate connector. In some embodiments, the moveable stair system also includes a landing plate configured to cover a gap disposed between the staircase and a first landing. In certain embodiments, the first landing connection system is further operatively connected to a first landing.

It is to be understood that both the foregoing general description and the following detailed description are exemplary and are intended to provide further explanation of the disclosed subject matter claimed.

BRIEF DESCRIPTION OF THE DRAWINGS

So that the manner in which the above recited features of the present disclosure can be understood in detail, a more particular description of the disclosure, briefly summarized above, can be had by reference to embodiments, some of which are illustrated in the appended drawings. It is to be noted, however, that the appended drawings illustrate only exemplary embodiments and are therefore not to be considered limiting of its scope, and can admit to other equally effective embodiments.

To facilitate understanding, identical reference numerals have been used to designate identical elements that are common to the figures. It is contemplated that elements and features of one embodiment can be beneficially incorporated in other embodiments without further recitation.

DETAILED DESCRIPTION

Figure 1:
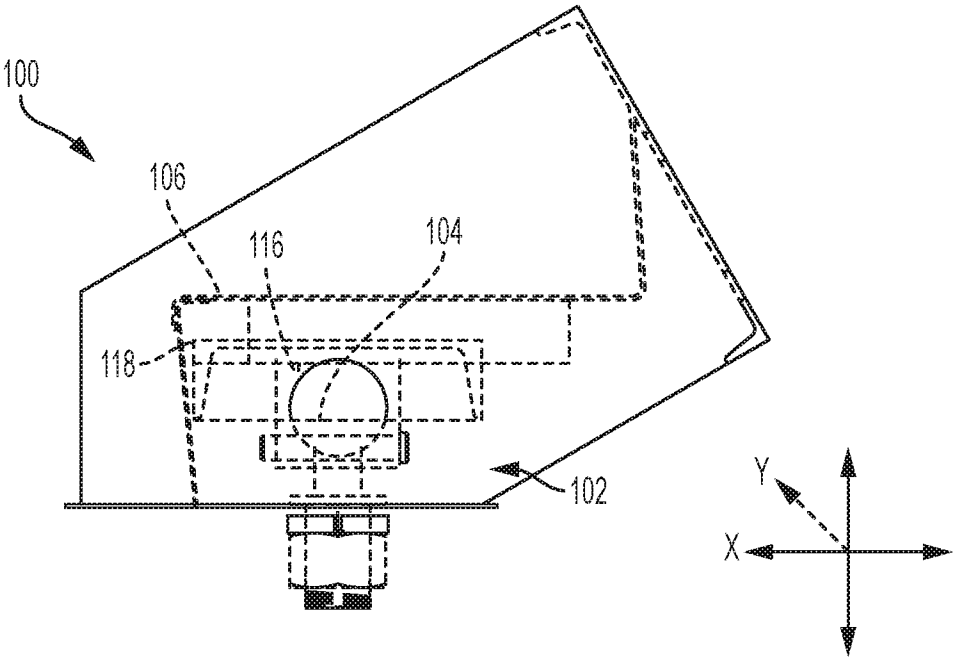
FIG. 1 schematically illustrates a side view of a first landing connection system of a stair system for allowing rotational movement of stairs, according to an example embodiment.

The present disclosure relates to stair systems and methods for allowing stair movement, including rotational movement, between building levels while maintaining the structural integrity of the stair system for safe egress passage. The systems and methods of the present disclosure allow for independent movement of the surrounding building walls, landings, floor slabs, and/or any other portion of the surrounding building structure or stair system. The embodiments of the present disclosure are suitable for use in both new constructions as well as in existing constructions for retrofit applications to allow for movement between levels, landings, or within stairwell structures. Moreover, the embodiments of the present disclosure apply to both single and double stringer stairs; a double stringer embodiment is used in the accompanying drawings for purposes of illustration only. Furthermore, the term "stair" or "stairs" means a series of risers and treads adjacent to or between stringers. The term "stairs" or "staircase" further includes the definition, meaning, and use of the term "stair assembly." The present disclosure can reduce stair damage during building movement whether it is from wind, thermal, explosive, seismic activity, and/or any other type of suitable force or experience, as the present disclosure allows for rotational movement, longitudinal movement, or a combination thereof.

Reference will now be made in detail to various exemplary embodiments of the disclosed subject matter, examples of which are illustrated in the accompanying drawings. The examples are not intended to limit the scope of the disclosed subject matter in any manner. The disclosed subject matter will be described in conjunction with the detailed description of the system. For purpose of illustration, and not limitation, FIGS. 1, 2, and 3 each schematically illustrate a first landing connection system 102 of a stair system 100. In some embodiments, the first landing connection system 102 is disposed between a stair or staircase 106 and a landing 108. In some embodiments, the landing 108 is an upper landing, while in other embodiments the landing 108 is a lower landing. In other embodiments, however, a first landing connection system 102 can be operatively connected with an upper landing and a lower landing. The first landing connection system 102 includes a single-point connection device 104. The single point connection device 104 can include any of, by way of example only, a shaft configuration, a pin-type configuration, a nut-and-bolt configuration, a ball-and-socket configuration, a pin-type configuration, a ball-joint-rod-end configuration, a swivel joint configuration, a configuration in which one or more structural shapes fit together, or any other suitable configuration which provides for a single point connection. Upon connection with a stair or staircase 106, the single-point connection device 104 allows for rotational movement. In some embodiments, the rotational movement includes movement in an X-direction and in a Y-direction. In some embodiments, movement in the X-direction is movement in the transverse direction or side-to-side movement. In some embodiments, movement in the Y-direction is movement in the longitudinal direction or back-and-forth movement.

As further shown in FIG. 1, the single-point connection device 104 can include a coupler 116 and a cross channel 118. The cross channel 118 is disposed adjacent the single-point connection device 104. The coupler 116 and the cross channel 118 can operatively connect the first landing connection system 102 with the landing 108 and/or staircase 106. In some embodiments, the cross channel 118 is U-shaped, however, any suitable shape can be utilized. In some embodiments, the coupler 116 is a part of the single-point connection device 104 and receives the mating end of the single-point connection device 104. In some embodiments, and by way of example only, a positive connection is made via a pin configured to secure a ball into an acceptor. The pin, ball, and acceptor accommodate rotation and push the X and Y movements to the opposing connection.

Figure 2:
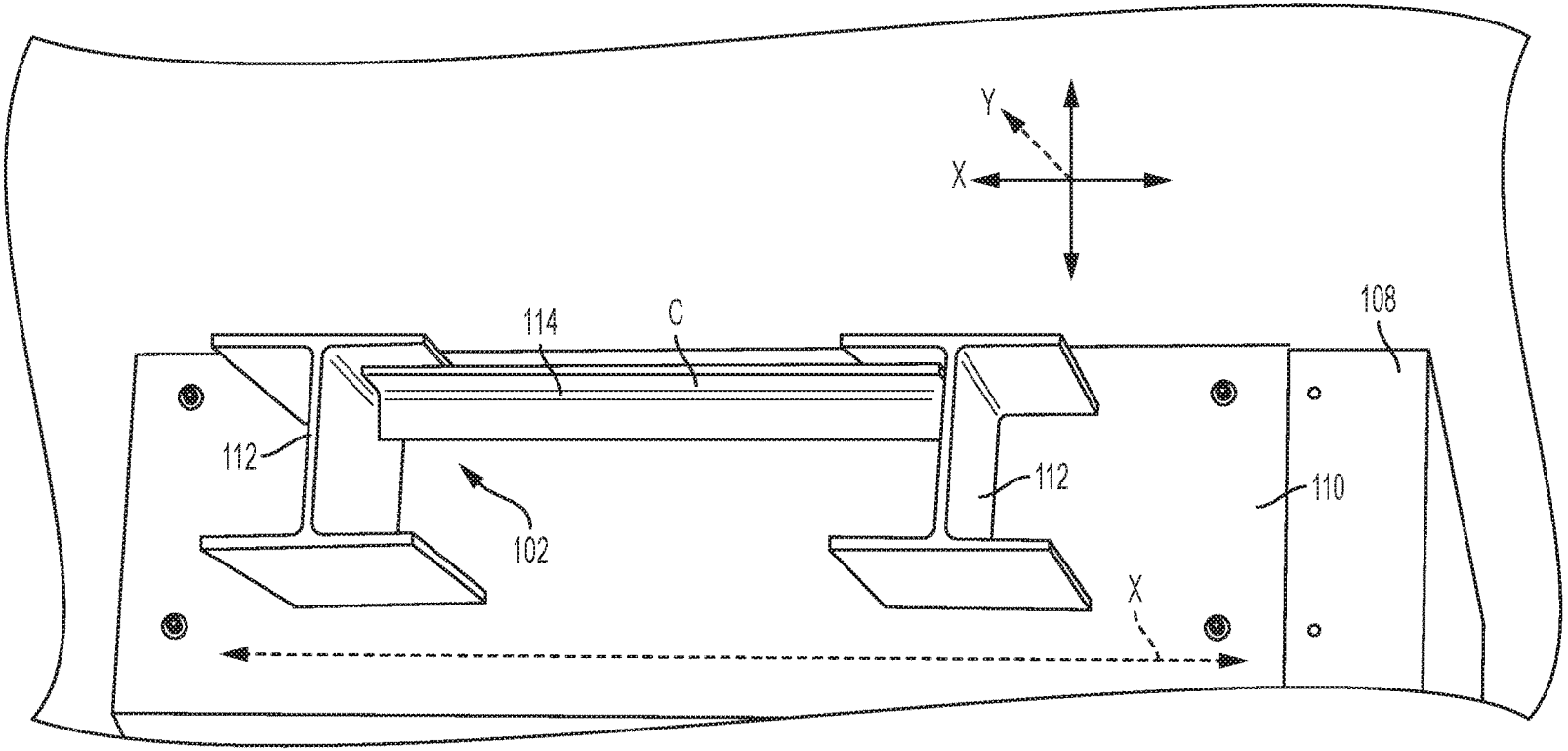
FIG. 2 schematically illustrates a perspective view of a first landing connection system of a stair system for allowing rotational movement of stairs, according to an example embodiment.
Figure 3:
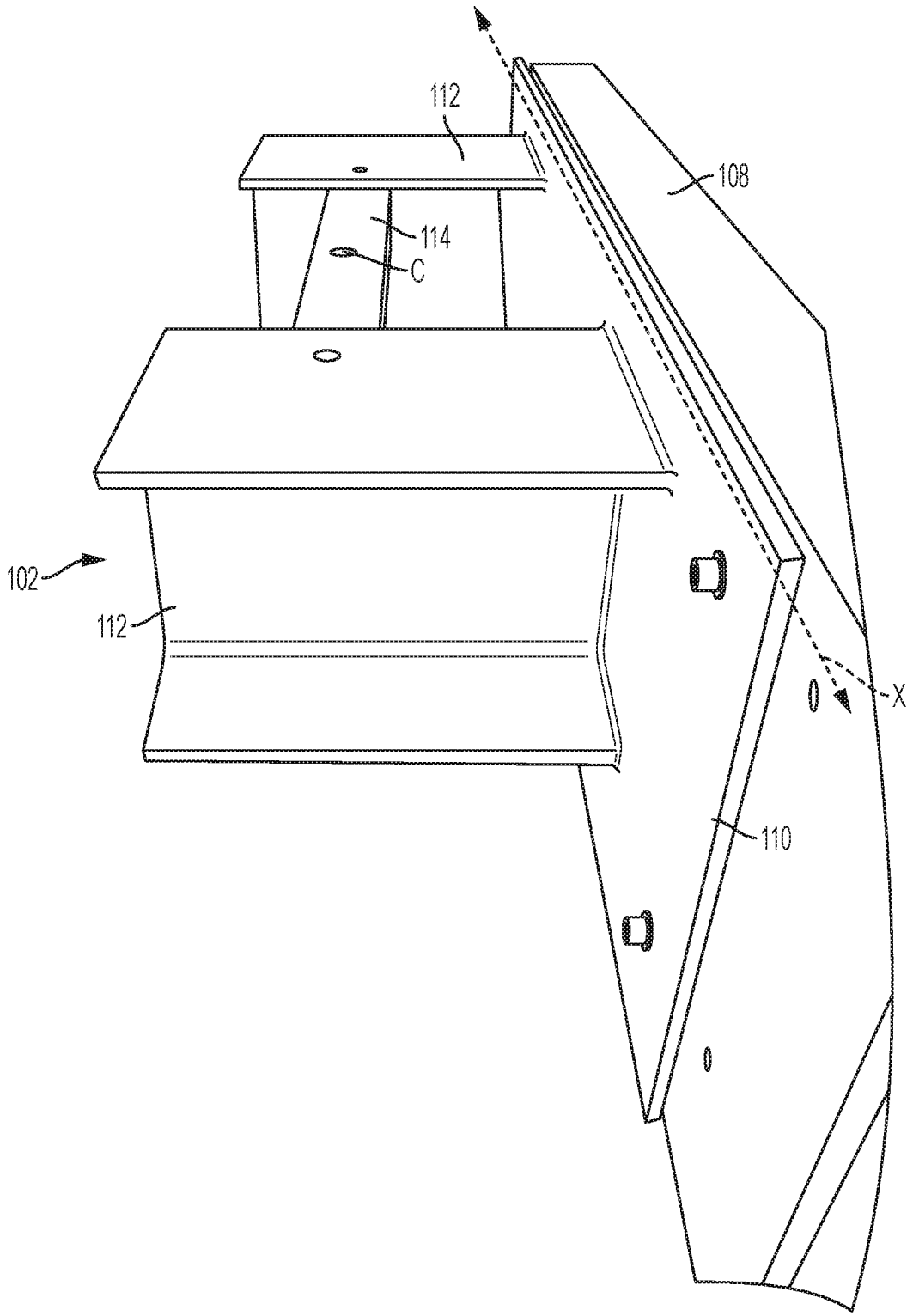
FIG. 3 schematically illustrates a side perspective view of the first landing connection system of the stair system for allowing rotational movement of stairs of FIG. 2, according to an example embodiment.

In some embodiments, the first landing connection system 102 includes a base plate 110 for connection with the landing 108, as shown in FIGS. 2 and 3, for example. Connection with the landing 108 can be made via any suitable connections means, for example, a bolted means. In some embodiments, one or more extenders 112 extend in an outward direction from the baseplate 110. As further shown in FIGS. 2 and 3, by way of example only, the one or more extenders 112 are I-beams. In certain embodiments, a crossbar 114 extends between the one or more extenders 112. The crossbar 114 includes a midpoint C. In certain embodiments, the single-point connection device 104 is centrally located proximate midpoint C within the first landing connection system 102.

Figure 4:
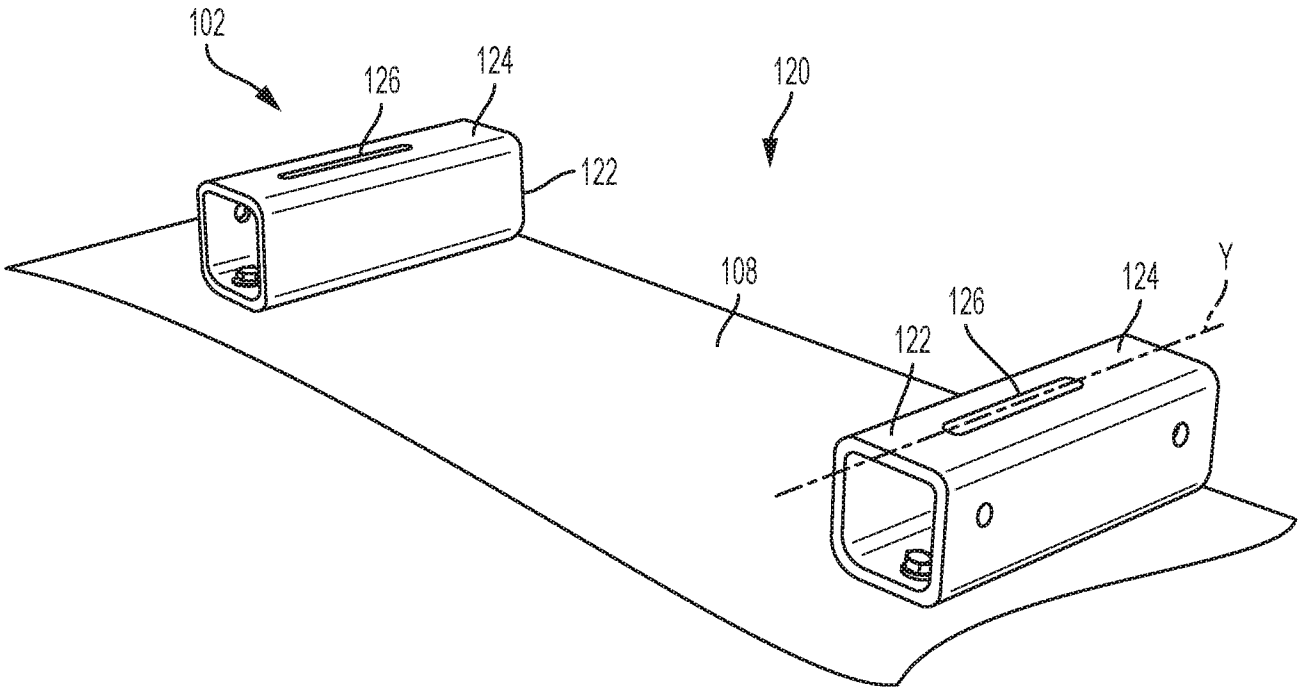
FIG. 4 schematically illustrates a perspective view of a second landing connection system of a stair system for allowing longitudinal movement of stairs, according to an example embodiment.
Figure 5:
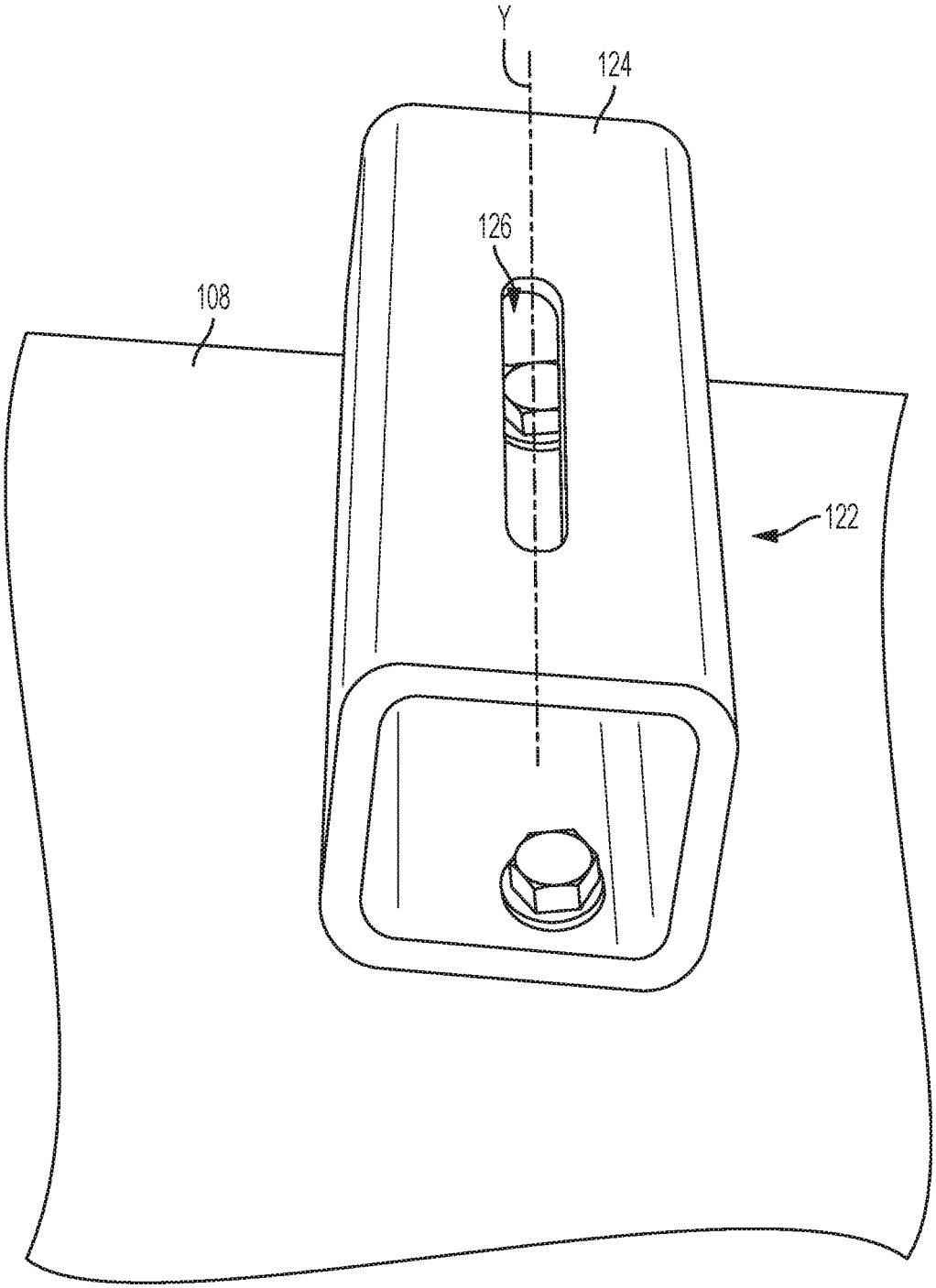
FIG. 5 schematically illustrates a perspective view of a secondary movement connection device of the second landing connection system of FIG. 4, according to an example embodiment.
Figure 6:
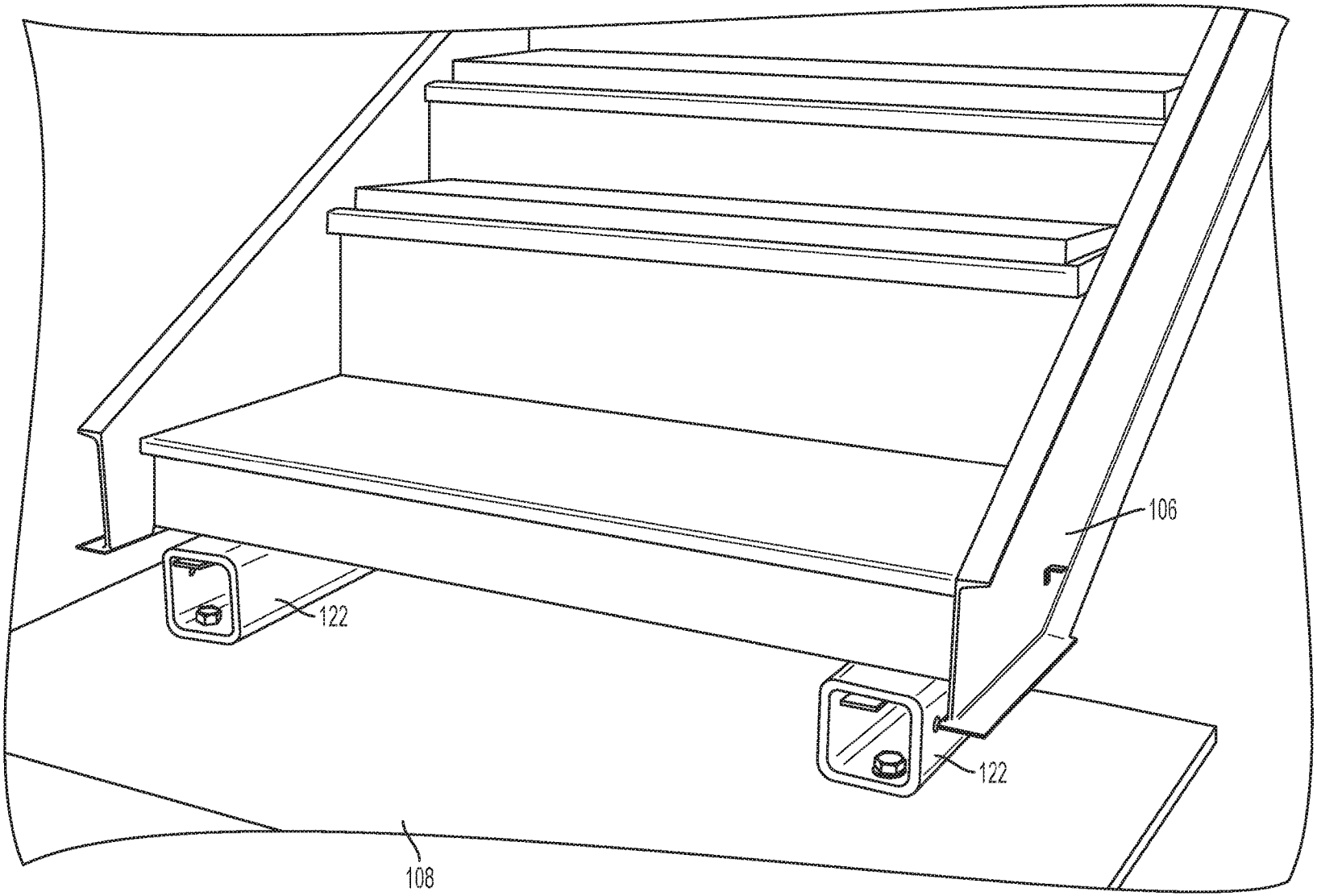
FIG. 6 schematically illustrates a staircase operatively connected with the second landing connection system of FIG. 4, according to an example embodiment.

For purpose of illustration and not limitation, FIGS. 4, 5, and 6 each schematically illustrate a second landing connection system 120 of the stair system 100. In some embodiments, the second landing connection system includes at least one secondary movement connection device 122. In some embodiments, the secondary movement connection device 122 includes a first face 124 with a slot 126 therethrough. The secondary movement connection device 122 is configured to be operatively connected with a stair or staircase 106 via any suitable connection, for example, a bolted connection. Further, in some embodiments, the secondary movement connection device 122 is configured for longitudinal movement in at least one direction, for example, in at least one of the X-direction and the Y-direction. In some embodiments, movement in the X-direction is movement in the transverse direction, or side-to-side movement, while movement in the Y-direction is movement in the longitudinal direction, or back-and-forth movement. As such, upon connection of the staircase 106 with the secondary movement connection device 122, the staircase is moveable in the longitudinal direction upon application of a force thereon.

In some embodiments, the at least one secondary movement connection device 122 includes a slotted connector, a track system connector, a guide rail connector, a wheeled connector, a roller connector, a slide connector, or a plate connector.

Figure 7B:
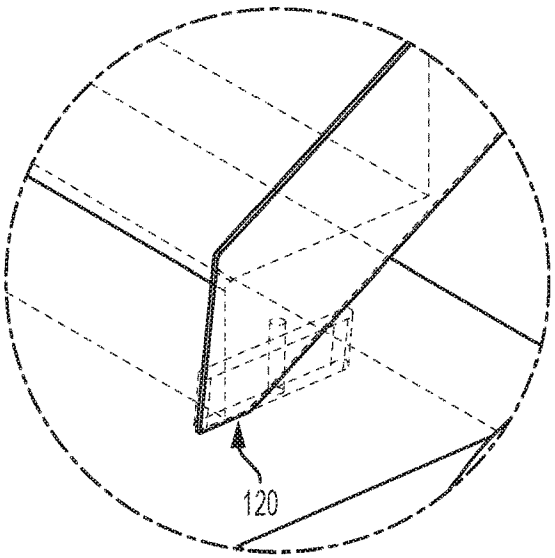
FIGS. 7A and 7B schematically illustrate perspective views of a staircase operatively connected with a stair system, according to an example embodiment.
Figure 7A:
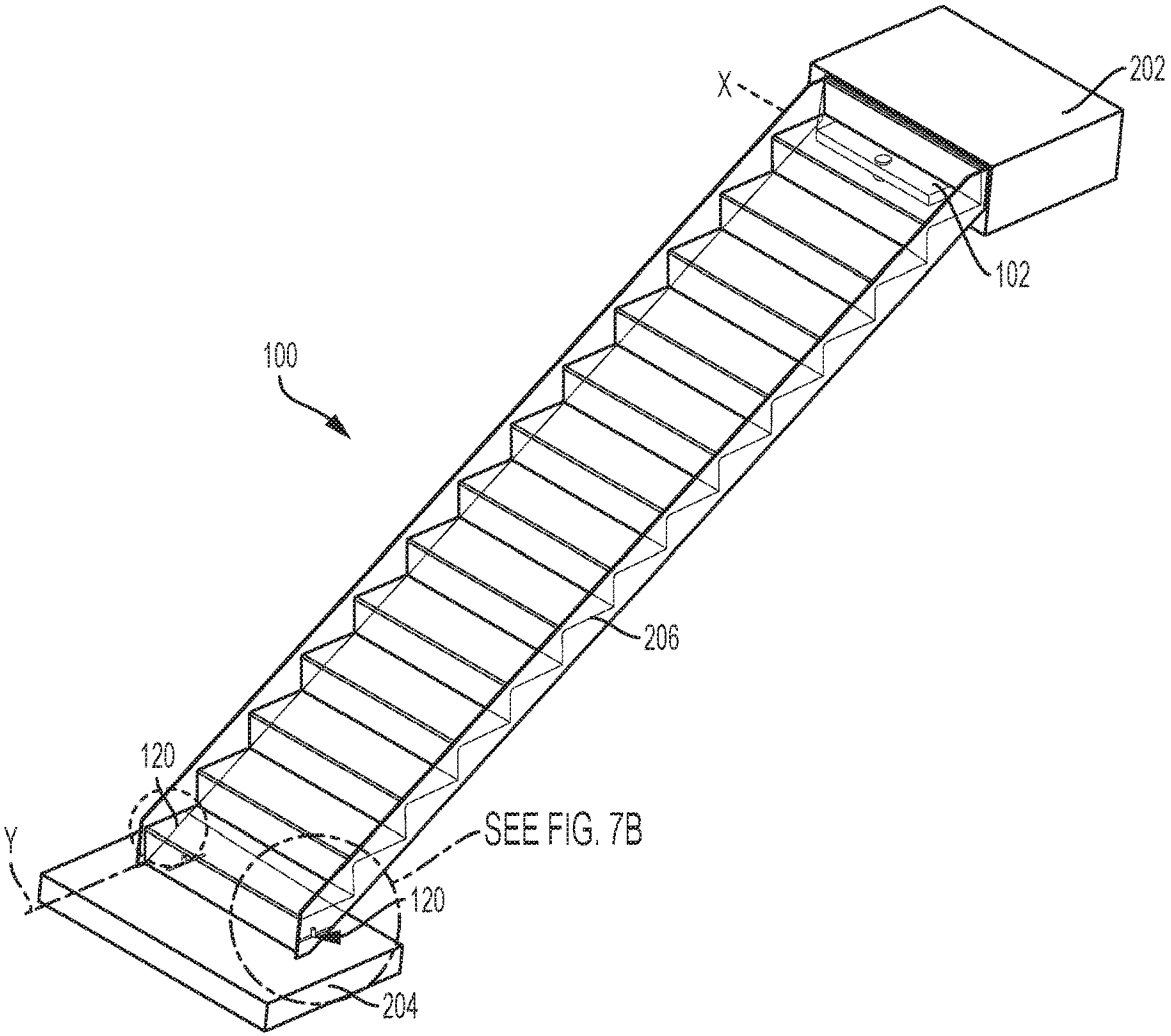

FIG. 7A schematically illustrates the stair system 100. As shown, the first landing connection system 102, shown in phantom, operatively connects an upper landing 202 with a staircase 206. Furthermore, the second landing connection system 120, shown in phantom in FIG. 7B, operatively connects a lower landing 204 with the staircase 206. In certain embodiments, however, the first landing connection system 102 can operatively connect the lower landing 204 with the staircase 206, and the second landing connection 120 can operatively connect the upper landing 202 with the staircase 206.

Figure 8A:
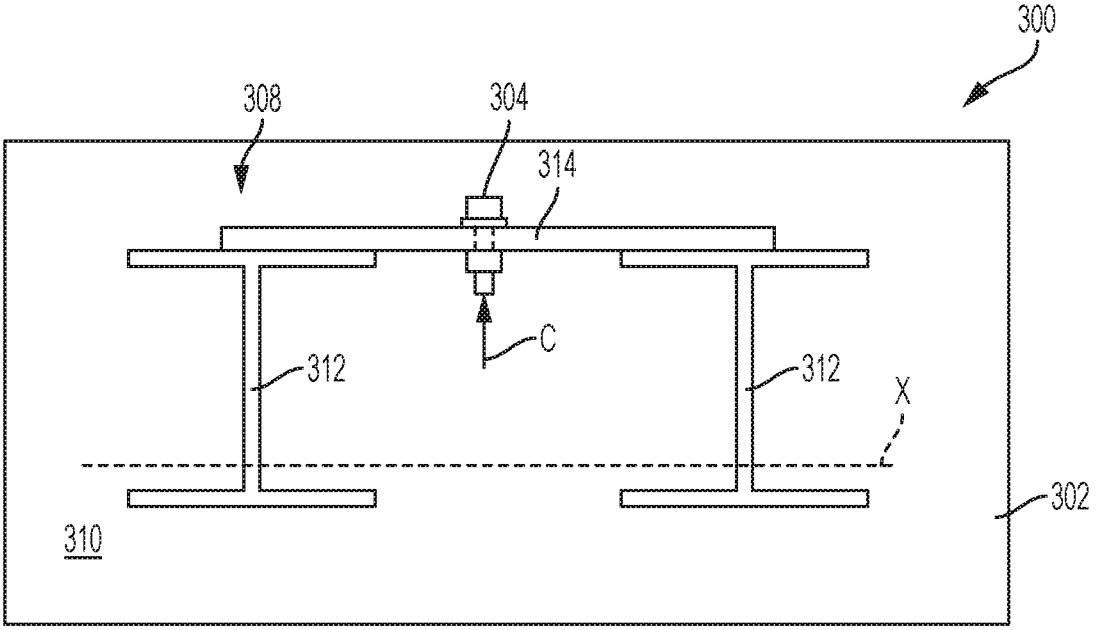
FIG. 8A schematically illustrates a front view of a first landing connection system of a stair system for allowing rotational movement and longitudinal movement of stairs, according to an example embodiment.
Figure 8B:
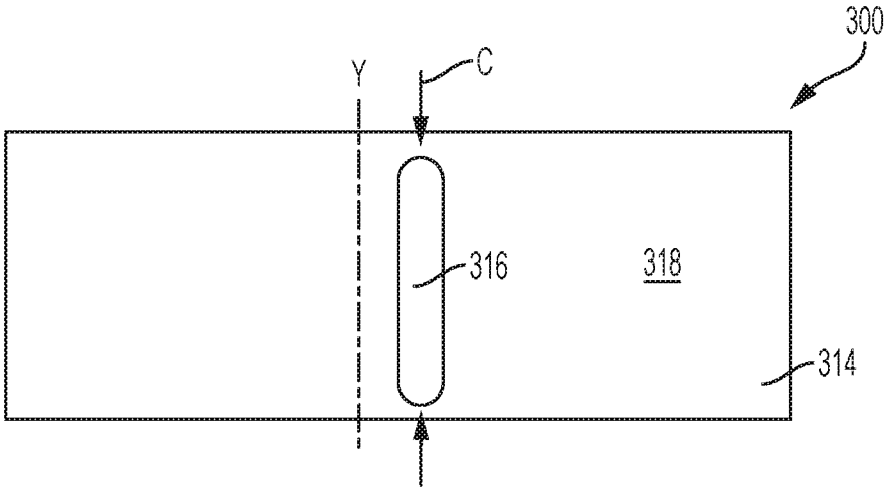
FIG. 8B schematically illustrates a top view of the first landing connection system of FIG. 8A, according to an example embodiment.

For purpose of illustration and not limitation, FIGS. 8A and 8B each schematically illustrate features of a stair system 300. The stair system 300 includes a first landing connection system 302. In some embodiments, the first landing connection system 302 is disposed between a stair or staircase and a landing. In some embodiments, the landing is an upper landing, while in other embodiments the landing is a lower landing. In certain embodiments, however, a first landing connection system 302 can be operatively connected with an upper landing and a lower landing. However, in some embodiments, the first landing connection system 302 can be operatively connected with a single landing whether it be an upper landing or a lower landing. The first landing connection system 302 includes a single-point connection device 304. The single point connection device 304 can include any of, by way of example only, a shaft configuration, a pin-type configuration, a nut-and-bolt configuration, a ball-and-socket configuration, a pin-type configuration, a ball-joint-rod-end configuration, a swivel joint configuration, a configuration in which one or more structural shapes fit together, or any other suitable configuration which provides for a single point connection. Upon connection with a stair or staircase, the single-point connection device 304 allows for rotational movement. In some embodiments, the rotational movement includes movement in an X-direction and in a Y-direction. In some embodiments, movement in the X-direction is movement in the transverse direction, or side-to-side movement, while movement in the Y-direction is movement in the longitudinal direction, or back-and-forth movement.

In some embodiments, the first landing connection system 302 can include a coupler or a cross channel, as described further herein for embodiments shown in FIG. 1. The cross channel is disposed adjacent the single-point connection device 304. The coupler and the cross channel can operatively connect the first landing connection system 302 with the landing and/or staircase. In some embodiments, the cross channel is U-shaped, however, any suitable shape can be utilized.

In some embodiments, the first landing connection system 302 includes a base plate 310 for connection with the landing. Connection with the landing can be made via any suitable connections means, for example, a bolted means. In some embodiments, one or more extenders 312 extend in an outward direction from the baseplate 310. As shown in FIG. 8A, by way of example only, the one or more extenders 312 are I-beams. In certain embodiments, the first landing connection system 302 includes a secondary movement connection system 308. The secondary movement connection system 308 includes a crossbar 314. The crossbar 314 extends between the one or more extenders 312. In certain embodiments, the crossbar 314 is coupled with the one or more extenders 312, for example, via a bolted connection, a welded connection, or any other suitable connection means. In some embodiments, the crossbar can be a face, plate, beam, rail, or any other suitable device. The crossbar 314 includes a midpoint C. In certain embodiments, the single-point connection device 304 is centrally located proximate midpoint C within the first landing connection system 302.

As further illustrated in FIG. 8B, for the purpose of illustration and not limitation, the secondary movement connection device 308 also includes a first face 318 of the crossbar 314. The first face 318 includes a slot 316 therein. In some embodiments, the slot 316 can extend through the first face 318 or through the crossbar 314. In certain embodiments, the slot 316 can extend in the longitudinal director, in the lateral direction, or in an approximately diagonal direction. In some embodiments, the single-point connection device is at least partially disposed through the slot to operatively connect the secondary movement connection device 308 with the single-point connection device 304, such that the single point connection device 304 is configured to move in the direction of the slot 316. As such, upon connection of a staircase with a landing via the stair system of FIGS. 8A and 8B, the staircase is moveable in a rotational direction—in a combination of an X-direction and a Y-direction—as well as in a longitudinal direction—in at least one of the X-direction and the Y-direction. In some embodiments, movement in the X-direction is movement in the transverse direction, or side-to-side movement, while movement in the Y-direction is movement in the longitudinal direction, or back-and-forth movement.

Figure 9:
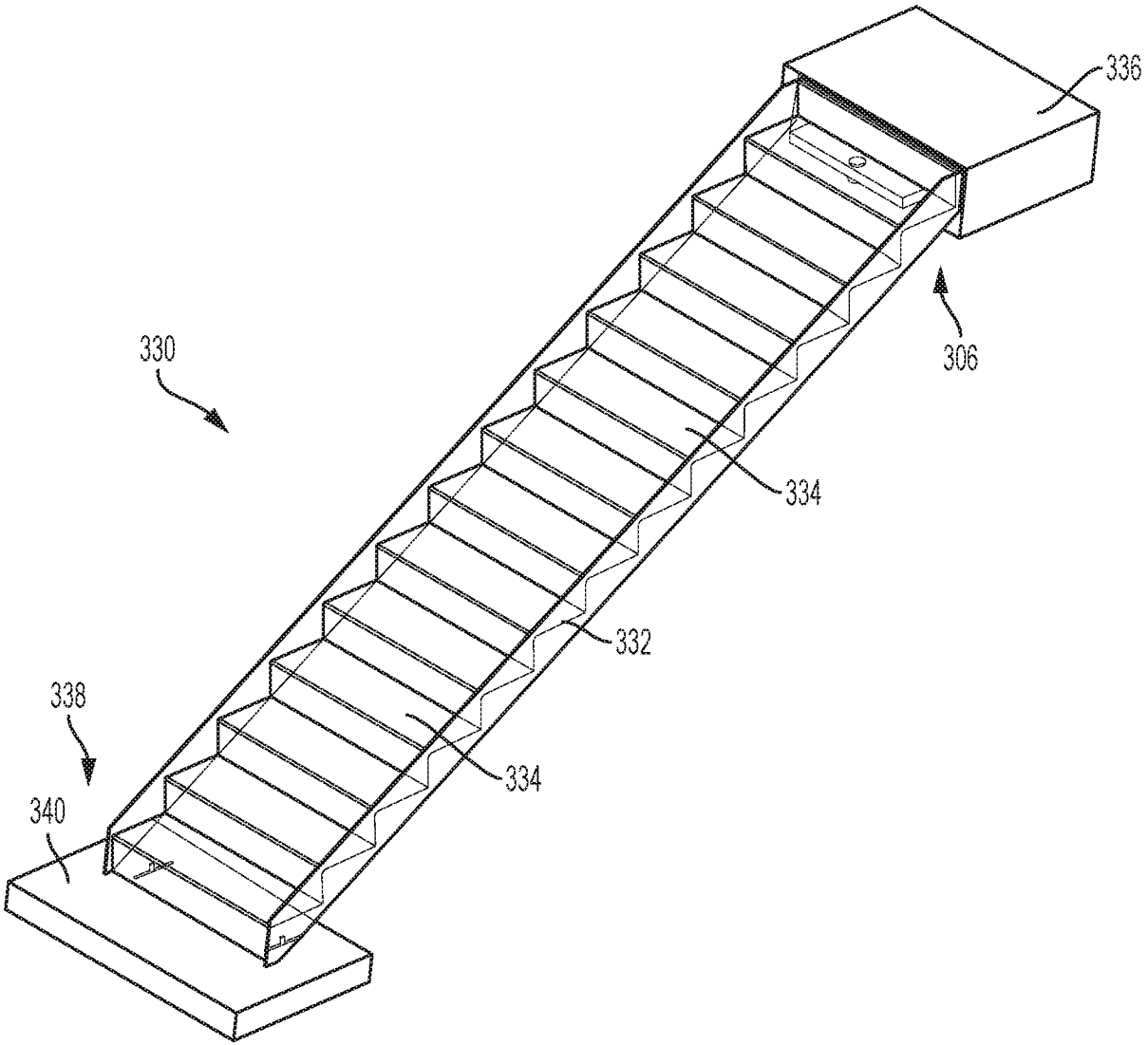
FIG. 9 schematically illustrates a perspective view of a moveable stair system, according to an example embodiment.

For purpose of illustration and not limitation, FIG. 9 schematically illustrates a moveable stair system 330. The moveable stair system includes a staircase 332 having one or more stairs 334. The first landing connection system 302 as discussed with reference to FIGS. 8A and 8B, supra, is disposed at a first end 306 of the staircase 332, wherein the first end 306 is opposite a second end 338. In some embodiments, the first landing connection system 302 is operatively connected with a first landing 336 via any suitable connection means. The first landing connection system 302 includes the single-point connection device 304 and the secondary movement connection device 308. The staircase 332 is operatively connected with the first single-point connection device 308. In some embodiments, the first landing connection system 302 includes a landing plate. The landing plate is operatively disposed to cover a gap between the staircase 332 and the first landing 336. In some embodiments, a second end 338 of the staircase 332 can rest on the landing or floor 340, or in other embodiments, the second end 338 of the staircase 332 can be operatively connected with the landing or floor 340 via any suitable connection means.

Exemplary benefits of stair systems in accordance with the disclosed subject matter include that the stair system allows for rotational movement to absorb landing displacement reducing damage to the stair system, thus allowing for safe egress. Furthermore, the disclosed connection means for connecting a staircase with a landing allows for the staircase to rotate, thus accommodating interstory drift in response to an event causing the structure to shake or move (i.e., earthquake, high winds, explosions, etc.). The present disclosure allows stairs the freedom to move to reduce force transfers to unsupported areas of a building, to maintain the structural integrity of the stairs during and after an event to allow for safe egress of occupants and safe ingress of emergency services to later allow for reoccupation of the building. Additionally, the stair systems disclosed are easily disposed at the top or bottom of a flight of stairs, thus allowing all movement to be located at one point (e.g., an intermediate landing) as opposed to requiring each axis of movement to be located at opposite ends of the flight. As such, one end of the flight of stairs can remain fixed or free and yet still provide the benefits of rotational movement. Additionally, testing has been performed and results indicate that, during movement events, stairs tend to naturally move in a rotational direction. As such, the rotational movement permitted by the systems of the present disclosure reduces the risk of damage not only to the stairs or building, but also to adjacent architecture and structural components.

The present disclosure is not limited to the specific combinations of the embodiments disclosed as it is contemplated that any number of the disclosed embodiments can be combined to allow for additional stair movement. Further embodiments herein can be combined with or include any of the features described in U.S. Pat. Nos. 9,758,981, 9,869,084, U.S. Patent Application Publication No. 2018/0100301, and/or International Application Serial No. PCT/US2018/029697, each of which is incorporated by reference herein in its entirety. The stair systems and methods disclosed allow for stair movement between building levels, platforms, landings, or the like while maintaining the structural integrity of the stair system for safe egress passage. The systems and methods disclosed further allow for independent movement of the surrounding building walls, landings, floor slabs, and/or any other portion of the surrounding building structure to the stair system. The embodiments of the present disclosure are suitable for use in both new constructions as well as in existing constructions for retrofit applications to allow for movement between levels, landings, or within stairwell structures. The present disclosure can reduce stair damage during building movement whether it is from wind, thermal, or seismic activity, and/or any other type of suitable force or experience, as the present disclosure allows for rotational movement, longitudinal movement, directional movement, or a combination thereof. Furthermore, it is contemplated that the embodiments of the present disclosure are not limited to stairs or stair systems, but are also suitable for use with other construction, building, safety, and engineering needs. By way of example only, and not intended to be limiting, embodiments of the present disclosure can be used to operatively connect a wall and a floor to reduce building damage during a movement event.

While the foregoing is directed to embodiments described herein, other and further embodiments can be devised without departing from the basic scope thereof, and the scope thereof is determined by the claims that follow.

What is claimed is:

1. A stair system, comprising:

a first landing connection system operatively connected to a first landing about a single point by a single-point connection device configured to provide rotational movement in a combination of an X-direction and a Y-direction; and a second landing connection system operatively connected to a second landing, the second landing connection system comprising at least one secondary movement connection device configured to provide longitudinal movement in at least one of the X-direction and the Y-direction.

2. The stair system of claim 1, wherein the single-point connection device is centrally located within the first landing connection system.

3. The stair system of claim 1, wherein the at least one secondary movement connection device includes a slotted connector, a track system connector, a guide rail connector, a wheeled connector, a roller connector, a slide connector, or a plate connector.

4. The stair system of claim 1, wherein the single-point connection device includes at least one of a shaft configuration, a pin configuration, a nut-and-bolt configuration, a ball-and-socket configuration, a hitch configuration, a ball-joint-rod-end configuration, a swivel joint configuration, or a configuration in which one or more structural shapes fit together.

5. The stair system of claim 4, wherein the single-point connection device further includes a coupler and a cross channel.

6. A stair system, comprising:

a first landing connection system comprising:

a single-point connection device configured to provide rotational movement in a combination of an X-direction and a Y-direction; and a secondary movement connection device operatively connected with the single-point connection device and configured to provide longitudinal movement in at least one of the X-direction and the Y-direction, wherein the first landing connection system is operatively connected to a first landing about a single point by the single-point connection device.

7. The stair system of claim 6, wherein the single-point connection device includes at least one of a shaft configuration, a pin configuration, a nut-and-bolt configuration, a ball-and-socket configuration, a hitch configuration, a ball-joint-rod-end configuration, a swivel joint configuration, or a configuration in which one or more structural shapes fit together.

8. The stair system of claim 7, wherein the secondary movement connection device comprises a first face having a slot therein, and wherein the single-point connection device is at least partially disposed through the slot to operatively connect the secondary movement connection device with the single-point connection device.

9. The stair system of claim 8, wherein the single-point connection device is centrally located within the first face.

10. A moveable stair system, comprising:

a staircase having one or more stairs;

a first landing connection system disposed at a first end of the staircase; and a second landing connection system disposed at a second end of the staircase, wherein the first end is opposite the second end, wherein the first landing connection system is operatively connected to a first landing about a single point by a single-point connection device configured to provide movement of the staircase in a rotational direction, wherein the movement in the rotational direction is movement in the X-direction and in the Y-direction, wherein the second landing connection system comprises a secondary movement connection device configured to provide movement of the staircase in a longitudinal direction, and wherein the movement in the longitudinal direction includes movement in at least one of the X-direction and the Y-direction.

11. The moveable stair system of claim 10, wherein the single-point connection device is centrally located within the first landing connection system.

12. The moveable stair system of claim 10, wherein the secondary movement connection device includes a slotted connector, a track system connector, a guide rail connector, a wheeled connector, a roller connector, a slide connector, or a plate connector.

13. The moveable stair system of claim 10, wherein the second landing connection system is further operatively connected to a second landing.

14. The moveable stair system of claim 10, further comprising a landing plate operatively connected to the first landing connection system and configured to cover a gap disposed between the staircase and the first landing.

15. The moveable stair system of claim 10, wherein the single-point connection device includes at least one of a shaft configuration, a pin configuration, a nut-and-bolt configuration, a ball-and-socket configuration, a hitch configuration, a ball-joint-rod-end configuration, a swivel joint configuration, or a configuration in which one or more structural shapes fit together.

16. The moveable stair system of claim 15, wherein the single-point connection device further includes a coupler and a cross channel.

17. A moveable stair system, comprising:

a staircase having one or more stairs; and a first landing connection system disposed at a first end of the staircase, wherein the first end is opposite a second end of the staircase, and wherein the first landing connection system comprises:

a single-point connection device configured to provide rotational movement in a combination of an X-direction and a Y-direction; and a secondary movement connection device operatively connected with the single-point connection device and configured to provide longitudinal movement in at least one of the X-direction and the Y-direction, wherein the first landing connection system is operatively connected to a first landing about a single point by the single-point connection device.

18. The moveable stair system of claim 17, wherein the secondary movement connection device includes a slotted connector, a track system connector, a guide rail connector, a wheeled connector, a roller connector, a slide connector, or a plate connector.

19. The moveable stair system of claim 17, further comprising a landing plate configured to cover a gap disposed between the staircase and the first landing.

20. The moveable stair system of claim 17, wherein the secondary connection device includes a second landing connection system operatively connected to a second landing.

21. The moveable stair system of claim 17, wherein the single-point connection device includes at least one of a shaft configuration, a pin configuration, a nut-and-bolt configuration, a ball-and-socket configuration, a hitch configuration, a ball-joint-rod-end configuration, a swivel joint configuration, or a configuration in which one or more structural shapes fit together.

22. The moveable stair system of claim 21, wherein the secondary movement connection device comprises a first face having a slot therein, and wherein the single-point connection device is at least partially disposed through the slot to operatively connect the secondary movement connection device with the single-point connection device.

23. The moveable stair system of claim 22, wherein the single-point connection device is centrally located within the first face.

* * * * *